US007472837B2

(12) United States Patent
Weaver et al.

(10) Patent No.: US 7,472,837 B2
(45) Date of Patent: Jan. 6, 2009

(54) SYSTEM, METHOD, AND APPARATUS FOR RAILROAD GUIDE RAIL SUPPORT

(75) Inventors: Brian Weaver, Burlington, KY (US); Robert C. Roberts, Jr., Talladega, AL (US); Mark Sutcliffe, Fort Mitchell, KY (US)

(73) Assignee: Progress Rail Services Corp., Albertville, AL (US)

( * ) Notice: Subject to any disclaimer, the term of this patent is extended or adjusted under 35 U.S.C. 154(b) by 385 days.

(21) Appl. No.: 11/454,516

(22) Filed: Jun. 16, 2006

(65) Prior Publication Data

US 2007/0075155 A1 Apr. 5, 2007

Related U.S. Application Data

(63) Continuation-in-part of application No. 11/243,765, filed on Oct. 5, 2005.

(51) Int. Cl.
*E01B 5/00* (2006.01)

(52) U.S. Cl. ..... 238/17; 238/310; 238/338; 238/357

(58) Field of Classification Search ..... 246/441, 246/445; 238/17, 18, 19, 20, 21, 22, 23, 238/379, 310, 316, 338, 336, 343, 348, 349, 238/351, 355, 357; 104/242
See application file for complete search history.

(56) References Cited

U.S. PATENT DOCUMENTS

| | | | | |
|---|---|---|---|---|
| 1,463,943 | A * | 8/1923 | Fallon | 238/20 |
| 2,929,562 | A * | 3/1960 | Hosbein | 238/379 |
| 4,265,401 | A * | 5/1981 | Jackson | 238/17 |
| 5,148,980 | A * | 9/1992 | Fritz et al. | 238/17 |
| 5,176,318 | A * | 1/1993 | Young et al. | 238/17 |
| 6,279,833 | B1 * | 8/2001 | Schwiede | 238/17 |

* cited by examiner

*Primary Examiner*—Mark T Le
(74) *Attorney, Agent, or Firm*—Bracewell & Giuliani LLP

(57) ABSTRACT

A guide rail support assembly includes a brace and a guide rail positioned on the brace. A hook device having a base and two hooks extending from the base and around the brace and secures the guide rail to the brace. The brace has no apertures such that the hooks extend completely around the brace without penetrating any portion of the brace. Adjustment shims are positioned adjacent the brace and a spring clip is mounted adjacent the base and the adjustment shims for securing the hook device to the brace.

12 Claims, 12 Drawing Sheets

SYSTEM, METHOD, AND APPARATUS FOR RAILROAD GUIDE RAIL SUPPORT

This application is a continuation-in-part of U.S. patent application Ser. No. 11/243,765, filed on Oct. 5, 2005, and is incorporated herein by reference in its entirety.

BACKGROUND OF THE INVENTION

1. Technical Field

The present invention relates in general to railroad guide rails and, in particular, to an improved system, method, and apparatus for supporting a railroad guide rail.

2. Description of the Related Art

A guide or guard rail aligns the wheels on railroad cars to prevent damage to track components. Guide rails also force the wheels to follow a desired path where the wheels may derail. Guide rails are located in railroad tracks adjacent the high side of curves, across bridges, adjacent turnout frogs, and at elevated sections of track. At turnout frogs, guide rails divert the path of one wheel of a railroad car to cause the opposite wheel to be drawn away from the turnout frog. Otherwise, a wheel may strike the frog and cause undesired wear or damage to the frog.

Some guide rails are not adjustable and are replaced when the guide rail face has worn such that it no longer properly guides the path of the non-guarded wheels. Some guide rails are formed from track rail that is parallel to the guarded running rail. Installation of the heavy track rail was difficult and somewhat imprecise. In many instances, the guide rail assembly is mounted on the same tie plates as that of the traffic rail, thus linking the installation points of the guide rail to the tie spacing. Other guide rails are fastened to the traffic rail. Such fastening often requires drilling of the running rail, which makes installation difficult.

Still other guide rails are formed from rolled steel. The guide bars are mounted on a bracket or brace and provide a guide face parallel to the gage line of a running rail. The guard bars and the support brackets or braces are separate items, and only the guard bar is replaced when the guard face wears beyond an acceptable limit. Again, some guide rail assemblies do not have an adjustment to compensate for the wear of the guard face. However, some recent designs provide an adjustment to compensate for wear of the guard face.

Most guide rail assemblies are secured to tie plates for traffic rails or directly to the traffic rails themselves by threaded fasteners or by welding. Threaded fasteners require a high level of maintenance due to their tendency to loosen over a period of time. Those guide rail assemblies that are affixed to the running rail and require drilling of the running rail are time consuming and difficult to install and maintain. Thus, an improved guide rail support system that overcomes the problems associated with the prior art would be desirable.

SUMMARY OF THE INVENTION

One embodiment of a system, method, and apparatus for a guide rail support assembly comprises a brace and a guide rail positioned on the brace. The guide rail extends in a longitudinal direction. A hook device has a base and two or more hooks extending from the base perpendicular to the guide rail. The hooks extend around the brace and secure the guide rail to the brace. The brace has no apertures, such that the hooks extend completely around the brace without penetrating any portion of the brace. Adjustment shims are positioned adjacent the brace. A spring clip is mounted adjacent the base and the adjustment shims for securing the hook device to the brace.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
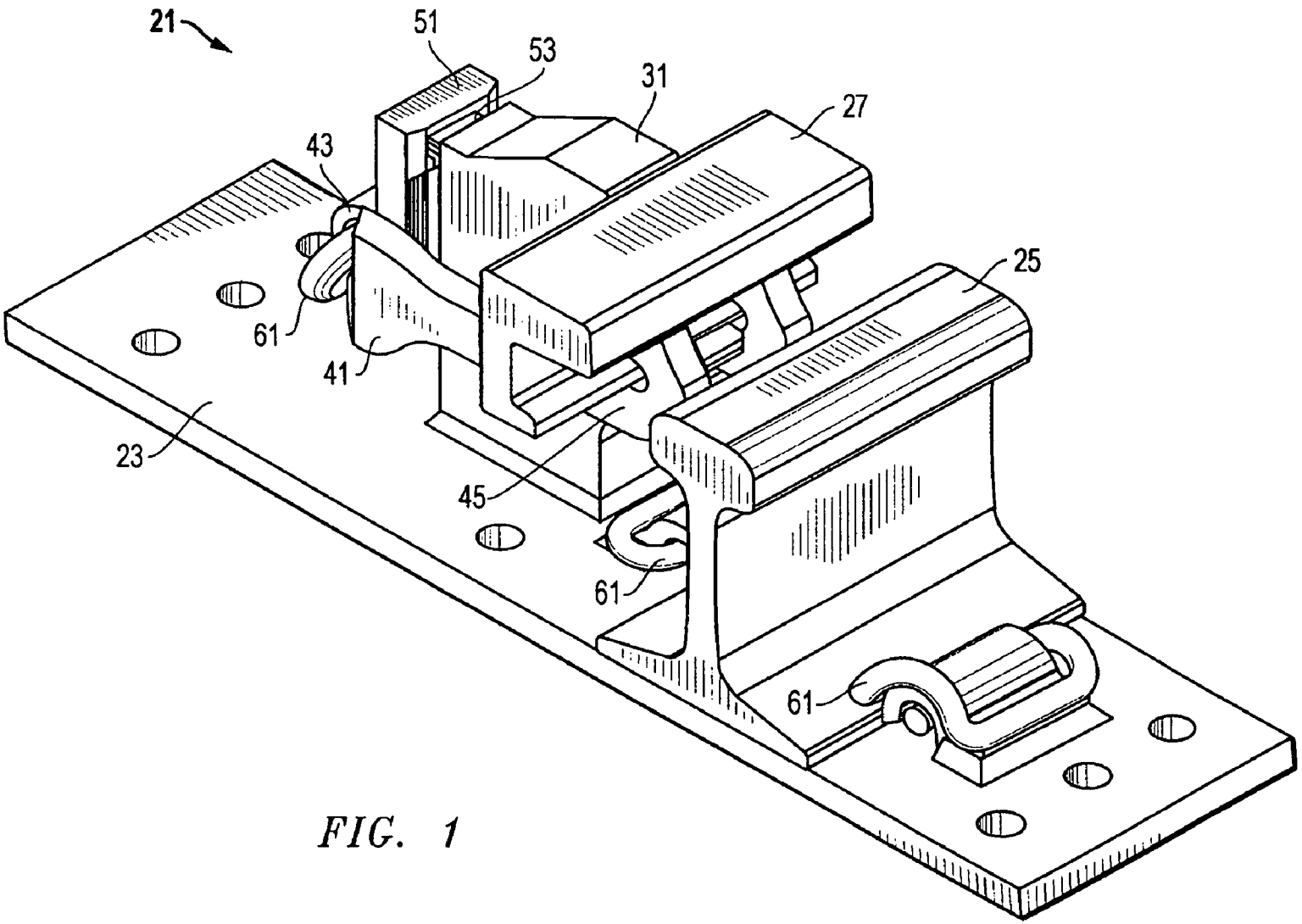
FIG. 1 is an isometric view of one embodiment of a guard rail support assembly constructed in accordance with the present invention.
Figure 2:
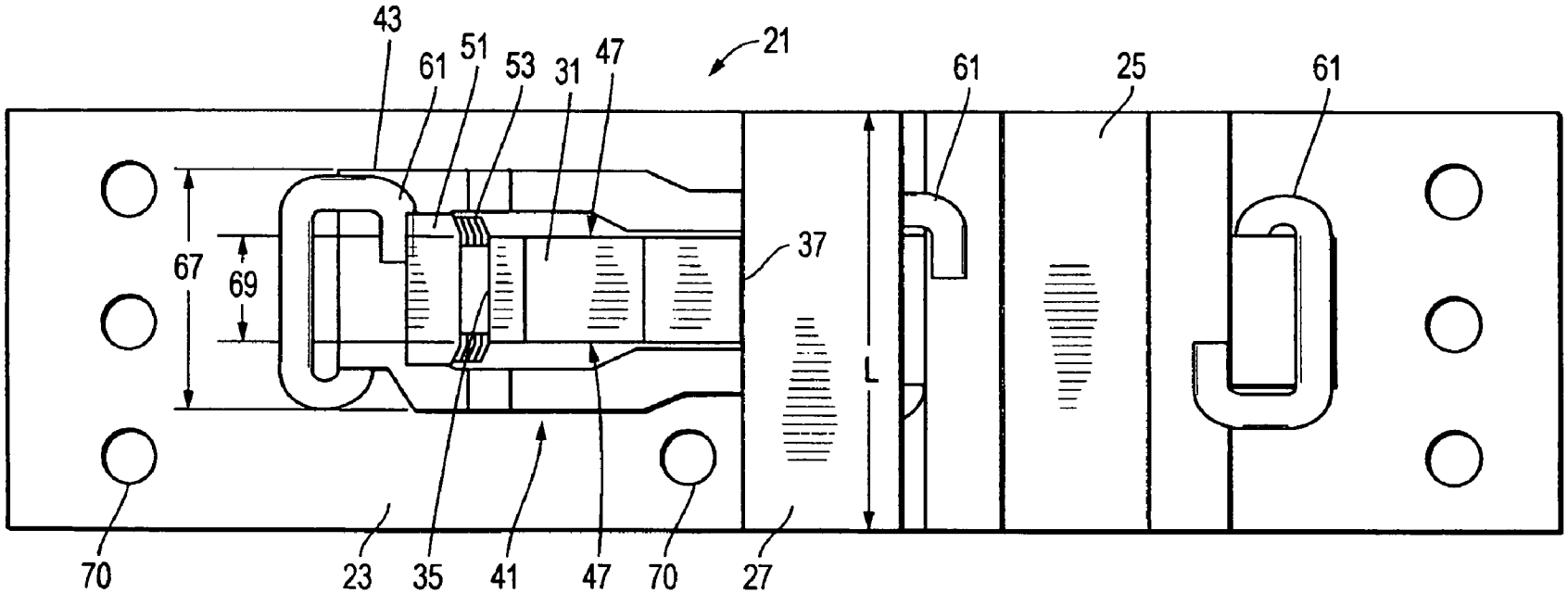
FIG. 2 is a top view of the assembly of FIG. 1 and is constructed in accordance with the present invention.
Figure 7:
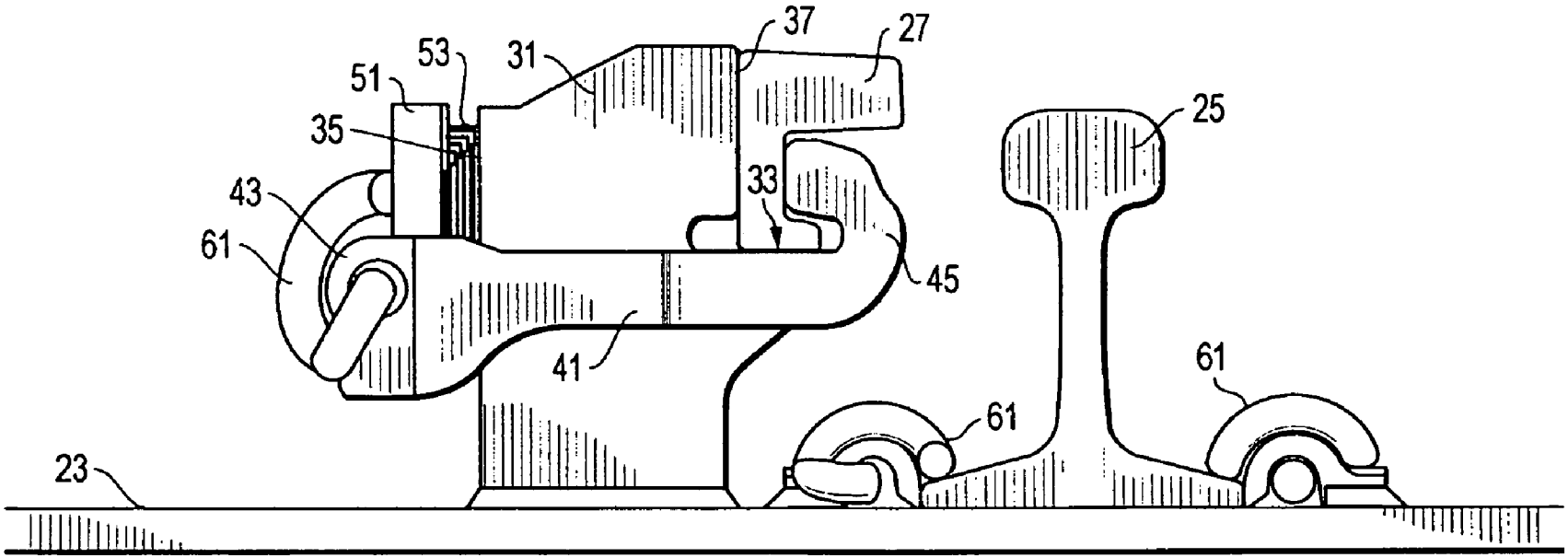
FIG. 7 is a side view of the assembly of FIG. 1 shown at a final stage of assembly after FIG. 6.

Referring to FIGS. 1, 2, and 7, one embodiment of a guide rail support assembly 21 constructed in accordance with the present invention is shown. Typically, assembly 21 is mounted to a tie plate 23, which also supports a main rail 25. The railroad section in which assembly 21 is located naturally comprises numerous plates 23 (one shown) and a pair or main rails 25 (one shown) mounted to the plates 23. The guide bar 27 that is supported by assembly 21 typically requires numerous assemblies 21, which are mounted to the plates 23 adjacent one of the main rails 25.

The illustrated guide rail support assembly 21 comprises a brace 31 that is directly mounted (e.g., welded) to plate 23. The brace 31 has a horizontal front ledge 33 and a vertical rear wall 35 that is opposite the front ledge 33. In the embodiment shown, the vertical rear wall 35 has no horizontal ledge extending therefrom, unlike prior art designs. Moreover, the brace 31 has no apertures in this embodiment. The guide bar 27 is positioned on the front ledge 33 of the brace 31 against a vertical front wall 37. The guide bar 27 has a longitudinal length "L" that defines a longitudinal direction.

The assembly 21 also includes a hook device 41 having, in one embodiment, a tubular base 43 and a plurality of hooks 45 (e.g., two) extending from the tubular base 43. The hooks 45 extend completely around the lateral sides 47 (FIG. 2) of the brace 31, and do not penetrate any portion of the brace 31 to secure the guide bar 27 to the brace 31. A spacer block 51 is positioned between the base 43 and the brace 31. One or more adjustment shims 53 having one or more thicknesses are positioned adjacent to the base 43 between the spacer block 51 and the rear wall 35 of the brace 31. Alternatively, shims 53 may be positioned between spacer block 51 and spring clip 61. Shims 53 also may be initially positioned between the guide rail 27 and the front wall 37 of the brace 31 (FIG. 8), depending on the application. The spacer block 51 has one or more lips that land on one or more shelves adjacent base 43. Shims 53 have L-shaped portions that land in a cavity in spacer block 51 to prevent vertical movement. The shims 53 are secured from lateral movement by brace 31, and from longitudinal movement by their bent wings (FIG. 2). A conventional spring clip 61 is mounted to the base 43 and engages the spacer block 51 for securing the hook device 41 to the brace 31.

In one embodiment, the base 43 of the hook device 41 comprises a horizontal tubular base extending in the longitudinal direction for receiving a straight end of the spring clip 61. The hook device 41, including the horizontal tubular base 43, has a longitudinal width 67 (FIG. 2) that is greater than a longitudinal width 69 of the brace 31. In this version, the longitudinal width 69 of the brace 31 is reduced such that the brace 31 provides clearance for the optional installation of at least two screw spikes 70 (FIG. 2; one shown) in the plate 23 underlying the brace 31.

Figure 9:
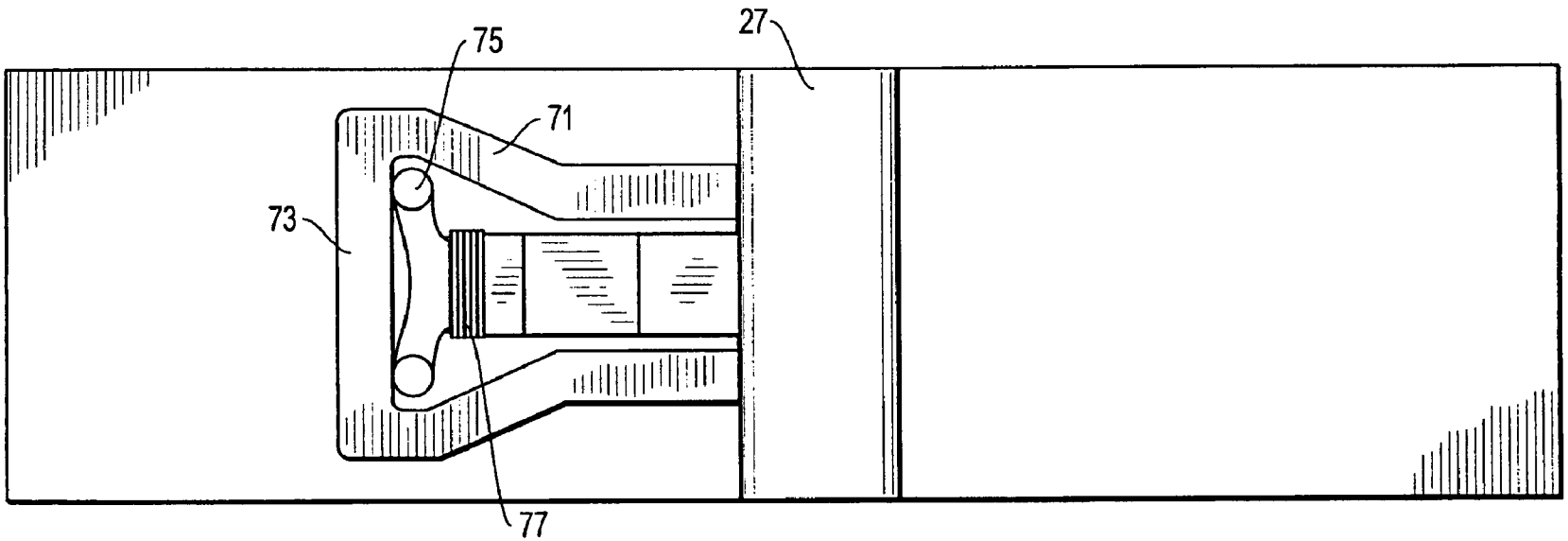
FIG. 9 is a top view of an alternate embodiment of a guard rail support assembly constructed in accordance with the present invention.

In an alternate embodiment (FIG. 9), an alternate design for a hook device 71 is used comprising a flat vertical wall base 73, rather than a tubular shaped base. In this version, the spring clip is a flat compression spring 75 that is located directly between the base 73 and the adjustment shims 77 as shown.

Figure 3:
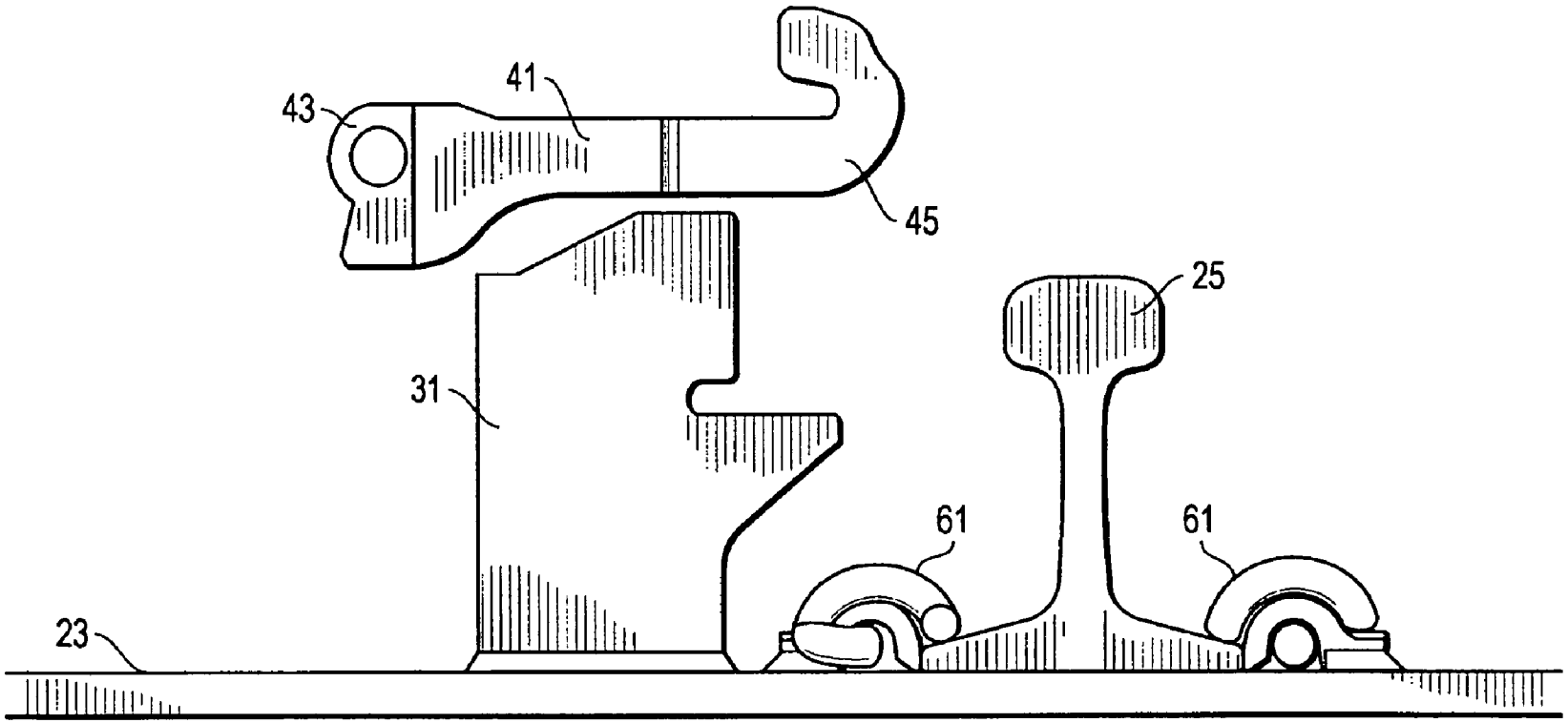
FIG. 3 is a side view of the assembly of FIG. 1 shown at an initial stage of assembly.
Figure 4:
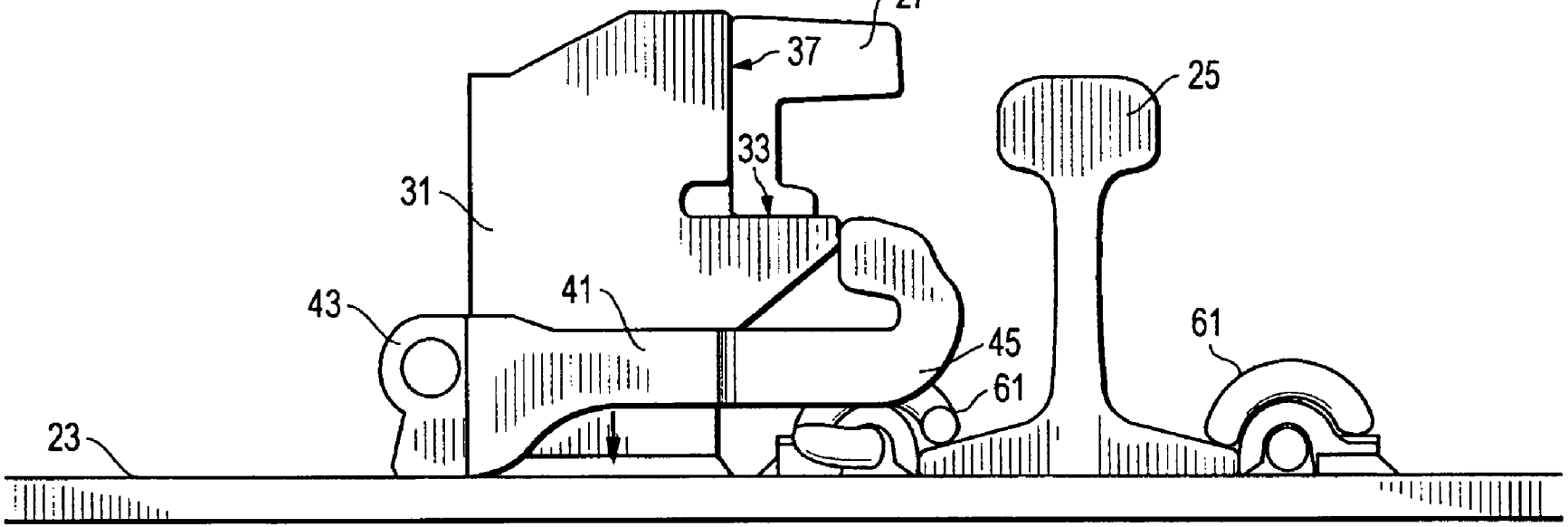
FIG. 4 is a side view of the assembly of FIG. 1 shown at a stage of assembly after FIG. 3.
Figure 5:
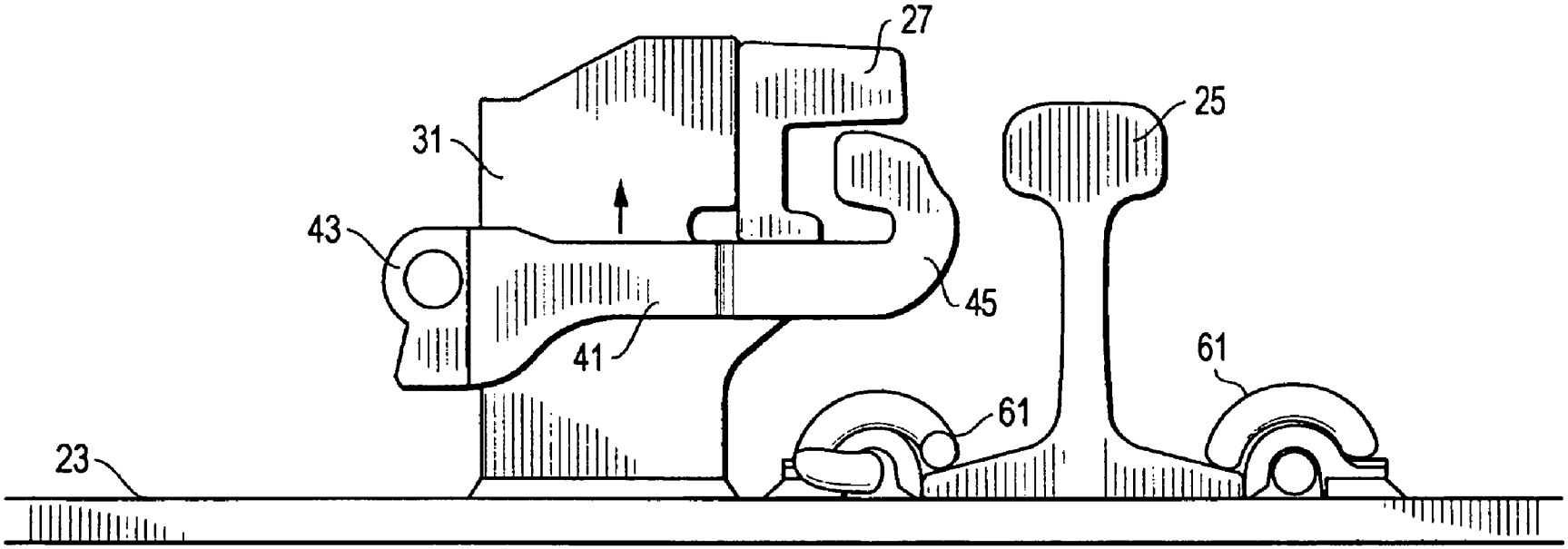
FIG. 5 is a side view of the assembly of FIG. 1 shown at a stage of assembly after FIG. 4.
Figure 6:
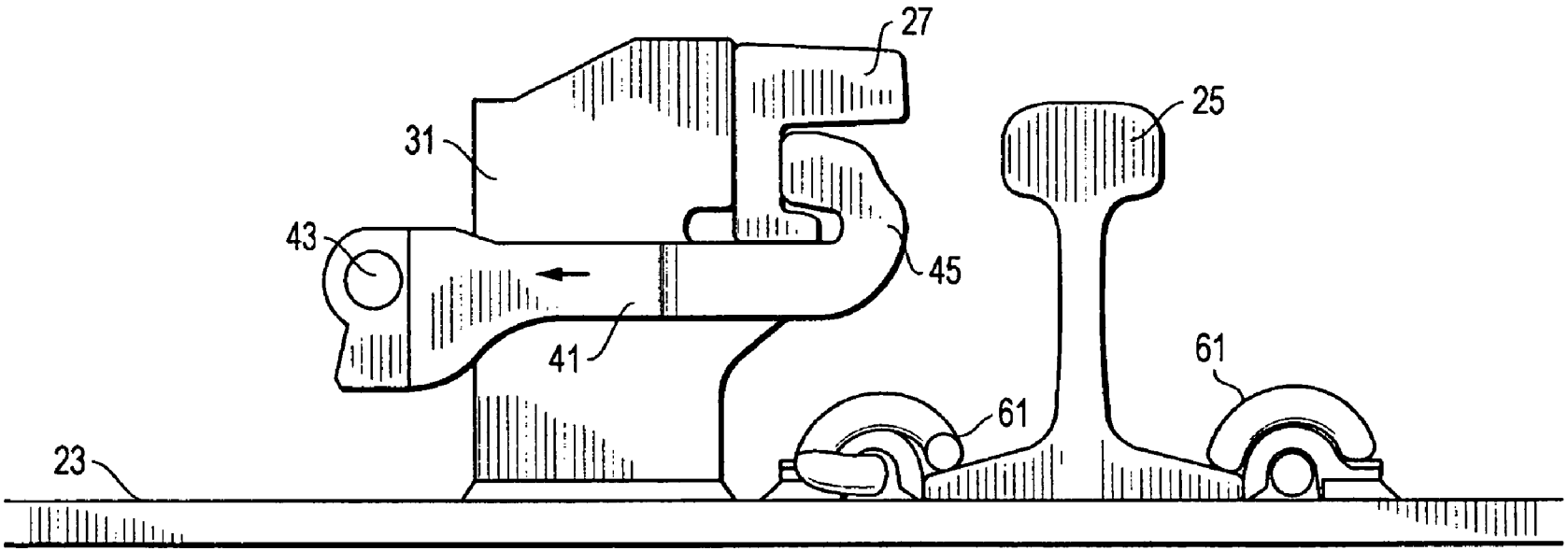
FIG. 6 is a side view of the assembly of FIG. 1 shown at a stage of assembly after FIG. 5.

Referring now to FIGS. 3-8, a sequence of steps that may be utilized to assemble the guide rail support assembly 21 are shown. In FIG. 3, the brace 31 is shown installed on plate 23 adjacent main rail 25. Hook device 41 is positioned above brace 31 with the two hooks 45 straddling the body of brace 31 therebelow. As shown in FIG. 4, hook device 41 is lowered straight down to plate 23, with hooks 45 now straddling brace 31 therebetween. Guide bar 27 is positioned on horizontal ledge 33 and against front vertical wall 37. In FIG. 5, hook device 41 is elevated such that it is close to or abuts the lower surface of guide bar 27 as shown, with hooks 45 out in front of guide bar 27. As shown in FIG. 6, hook device 41 is then moved rearward until hooks 45 seat in the pocket formed in guide bar 27. The hooks 45 continue to straddle brace 31. Finally (FIG. 7), the spacer block 51 and shims 53 are installed between the base 43 of hook device 41 and brace 31, before spring clip 61 is joined thereto to secure the entire assembly 21.

Figure 8:
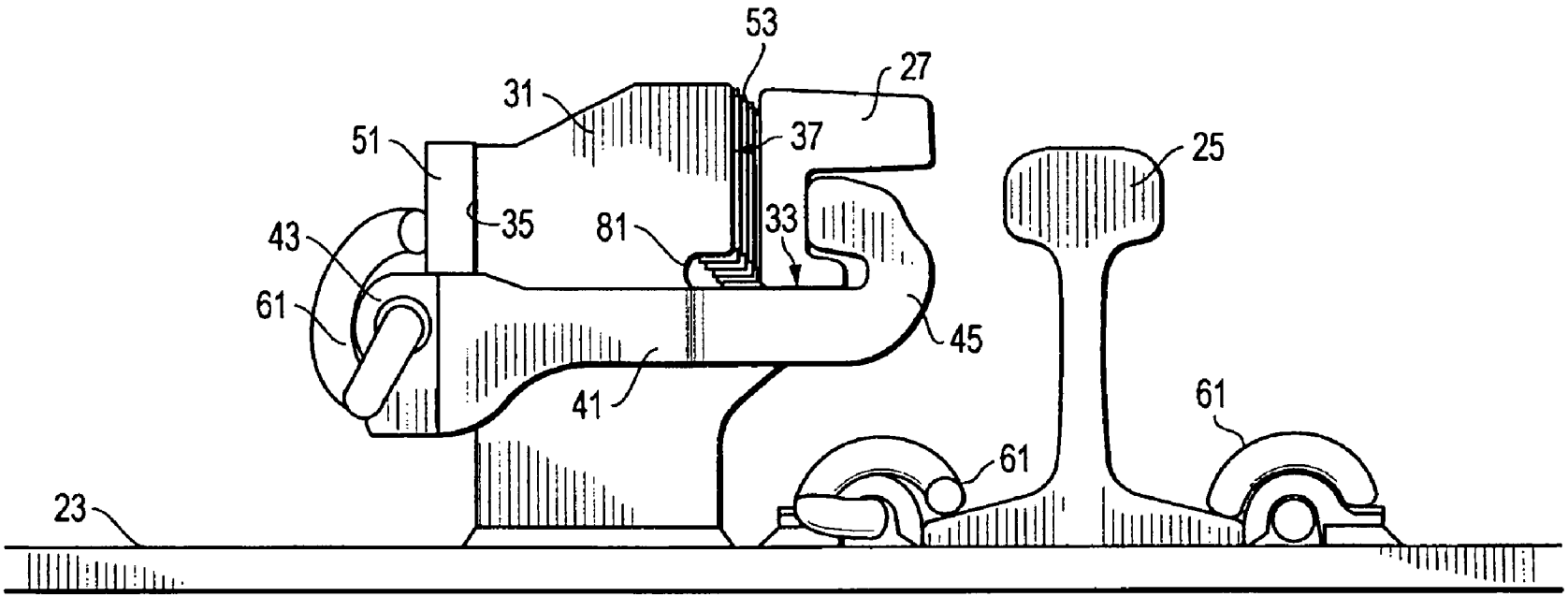
FIG. 8 is a side view of the assembly of FIG. 7 and illustrating a configuration for a worn guard bar.

Referring now to FIG. 8, the life of guide bar 27 may be extended after it is worn by relocating one or more of the shims 53 from rear surface 35 to front surface 37. Shims 53 are especially adapted to perform this function with their L-shaped bodies being located between brace 31 and guide bar 27. The L-shaped lip on shims 53 seats in a recess 81 located in brace 31 between surfaces 33 and 37. In this way, the wear surface of guide bar 27 is positioned laterally closer to main rail 25 and the train wheels that traverse it.

Figure 10:
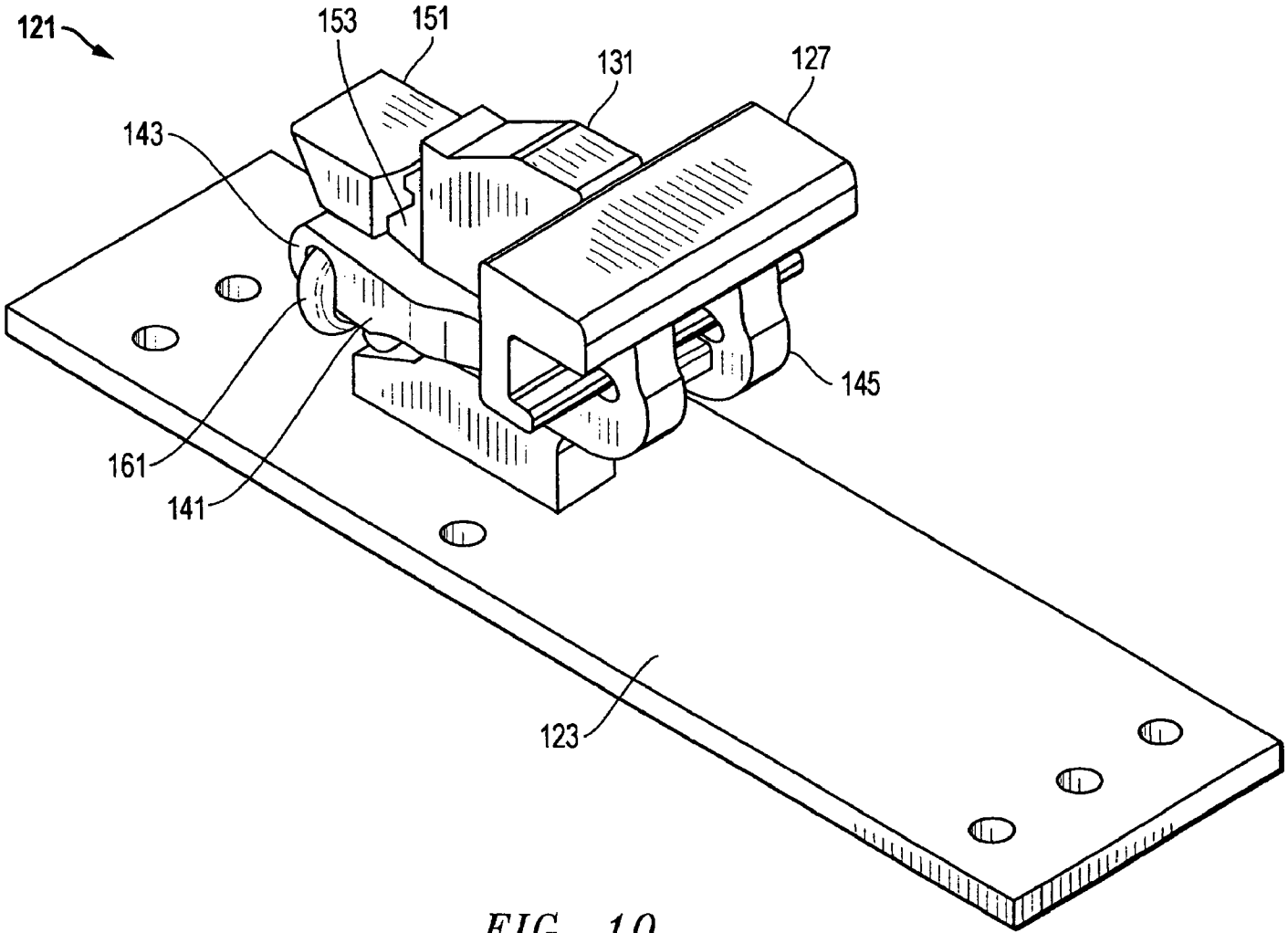
FIG. 10 is an isometric view of another alternate embodiment of a guard rail support assembly constructed in accordance with the present invention.
Figure 11:
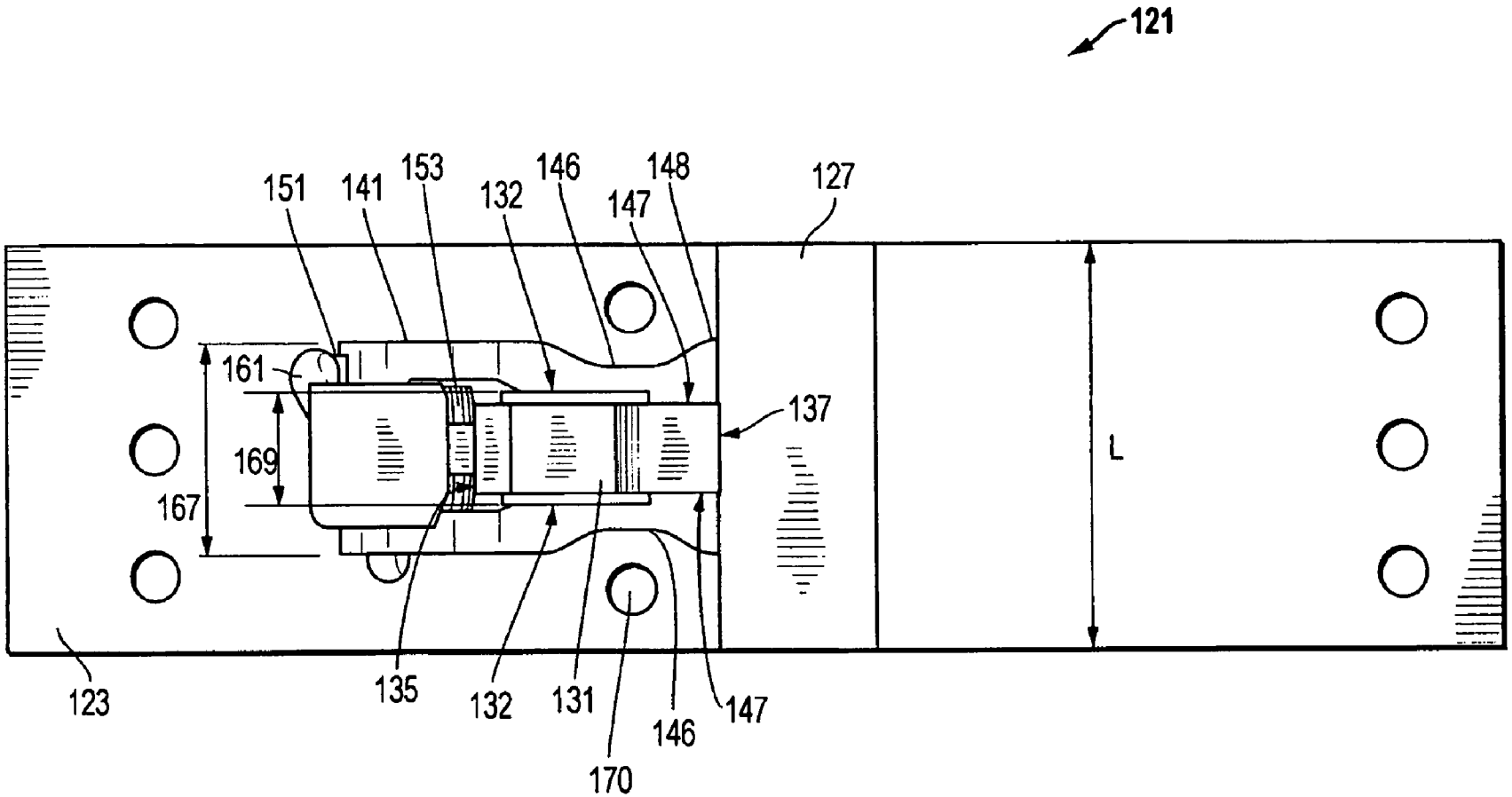
FIG. 11 is a top view of the assembly of FIG. 10 and is constructed in accordance with the present invention.
Figure 12:
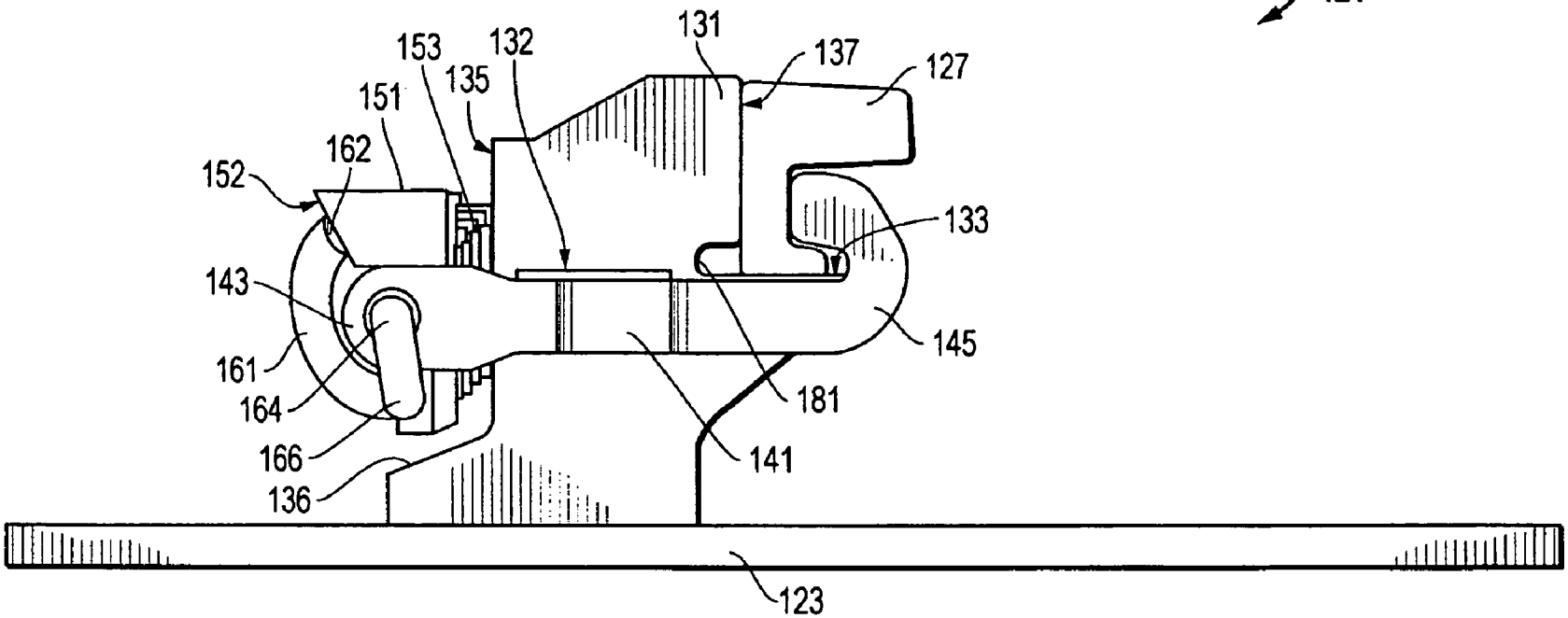
FIG. 12 is a side view of the assembly of FIG. 10.

Another alternate embodiment of a guide rail support assembly 121 is depicted in FIGS. 10-12. Assembly 121 is typically mounted to a tie plate 123, which also supports the main rails (not shown). As described above for an earlier embodiment, the guide bar 127 supported by assembly 121 typically requires numerous assemblies 121, which are mounted to numerous tie plates 123 adjacent one of the main rails.

Guide rail support assembly 121 comprises a brace 131 that is mounted to plate 123. The brace 131 has a horizontal front ledge 133 (FIG. 12) and a vertical rear wall 135 opposite the front ledge 133. In the embodiment shown, the vertical rear wall 135 has an extended flange 136 protruding rearward from a lower end thereof, thereby giving brace 131 a larger "footprint" than brace 31 of the previous embodiment. The larger footprint reduces the stresses put on plate 123, thereby extending its useful life. The configuration of flange 136 is also free of contact with spacer block 151 and spring clip 161. Like the previous embodiment, brace 131 has no apertures in this embodiment. However, in one embodiment, brace 131 is slightly narrower in the longitudinal direction compared to the previous embodiment of brace 31.

The guide bar 127 is positioned on the front ledge 133 of the brace 131 against a vertical front wall 137. The guide bar 127 has a longitudinal length "L" that defines a longitudinal direction. The assembly 121 includes a hook device 141 for engaging and retaining the guide bar 127. The hook device 141 has, in one embodiment, a tubular base 143 and a plurality of hooks 145 (e.g., two) extending from the tubular base 143. The hooks 145 extend completely around the lateral sides 147 (FIG. 11) of the brace 131, and do not penetrate any portion of the brace 131 to secure the guide bar 127 to the brace 131.

In one embodiment, there is a longitudinal clearance between the hooks 145 and the lateral walls 147 of brace 131. In addition, each hook 145 includes an outer concave recess 146 that provides additional clearance for the installation of spikes in holes 170. Accordingly, a second sweep 148 (i.e., additional thickness) is formed in the hooks 145 to increase the amount of material at the stressed ends of the hooks 145.

A spacer block 151 is positioned between the base 143 and the brace 131. The embodiment shown includes a vertical stop 132 for limiting the upward vertical movement of hook device 141 during its installation to form assembly 121. The illustrated embodiment comprises one thin, horizontal, elongated rectangular vertical stop 132 on each lateral side 147 of brace 131, although many other shapes also may be used. The vertical stops 132 contact an upper portion of hook device 141 between base 143 and hooks 145 as shown.

One or more adjustment shims 153 having one or more thicknesses are positioned adjacent to the base 143 between the spacer block 151 and the rear wall 135 of the brace 131. Alternatively, shims 153 may be positioned between spacer block 151 and spring clip 161. Shims 153 also may be initially positioned between the guide rail 127 and the front wall 137 of the brace 131 as described above for previous embodiments, depending on the application. The spacer block 151 has one or more lips that land on one or more shelves adjacent base 143. In one embodiment, shims 153 have L-shaped portions that land in a cavity in spacer block 151 to prevent vertical movement. The shims 153 are secured from lateral movement by brace 131, and from longitudinal movement by their bent wings (FIG. 11).

A spring clip 161 is mounted to the base 143 and engages the spacer block 151 for securing the hook device 141 to the brace 131. At least a portion of the rear surface 152 of the spacer block 151 is diagonally sloped toward brace 131. The upper end of spacer block 151 is wider in the lateral direction than the lower end of spacer block 151. A semi-cylindrical recess (not shown) is formed in a middle portion of spacer block 151 for receiving the lower end 164 of spring clip 161. The negative slope of rear surface 152 locates the spring clip 161 in a slightly counterclockwise rotated position from the previous embodiment, such that the upper end 162 of the spring clip 161 is located rearward (e.g., to the left in FIG. 12) of the lower end 164 of the spring clip 161, rather than substantially vertically aligned with each other as in the previous embodiment. In addition, the lowermost portion 166 of spring clip 161 is in physical contact only with spacer block 151, and does not contact base 143. Thus, spring clip 161 has three areas of contact, namely, two areas of contact 162, 166 with spacer block 151 and one area of contact 164 with base 143 vertically between said two areas of contact 162, 166.

In one embodiment, the base 143 of the hook device 141 comprises a horizontal tubular base extending in the longitudinal direction for receiving a straight end of the spring clip 161. The hook device 141, including the horizontal tubular base 143, has a longitudinal width 167 (FIG. 11) that, in one embodiment, is greater than a longitudinal width 169 of the brace 131. The longitudinal width 169 may or may not include the additional width provided by vertical stops 132, which may formed on or welded to brace 131. In the illustrated version, the longitudinal width 169 of the brace 131 is reduced such that the brace 131 provides clearance for the installation of at least two screw spikes in holes 170 in plate 123. The ability to use two or more screw spikes to secure plate 123 to the underlying railroad tie provides a more stable and rigid structure that significantly increases the useful life of the components and installation.

The life of guide bar 127 may be extended after it is worn by relocating one or more of the shims 153 from rear surface 135 to front surface 137. The L-shaped lip on shims 153 can seat in recess 181 (FIG. 12) located in brace 131, thereby positioning the wear surface of guide bar 127 closer to the main rail and the train wheels that traverse it.

The present invention has several advantages, including the ability to provide higher frictional resistance to longitudinal movement of the guide rail relative to the brace compared to conventional single-hook designs. The configuration of the tubular base of the hook device allows spring clips to be inserted in a straighter direction and with greater ease, thereby reducing the chance that the clip will jump out when first being driven in and/or finally removed. In contrast, some single hook designs can cause the clip to hit an installer on the first strike when driving the clip in, or on the last strike when driving the clip out. With the single upright or brace welded to the plate, the open area around the brace is increased. This provides clearance for hold down spike holes on both sides of the brace, whereas single hook designs with two welded uprights or braces do not provide as much clearance.

While the invention has been shown or described in only some of its forms, it should be apparent to those skilled in the art that it is not so limited, but is susceptible to various changes without departing from the scope of the invention.

What is claimed is:

1. A guide rail support assembly, comprising:

a brace adapted to support a guide rail extending in a longitudinal direction;

a hook device having a base and a plurality of hooks extending from the base around the brace and adapted to secure the guide rail to the brace;

a spacer block positioned between the base and the brace; and a spring clip mounted to the base and engaging the spacer block for securing the hook device to the brace, the spring clip having two areas of contact with the spacer block and one area of contact with the hook device.

2. A guide rail support assembly according to claim 1, wherein the plurality of hooks comprises two hooks, one on each lateral side of the brace relative to the longitudinal direction; and wherein each hook has a concave recess formed in an outer surface thereof adapted to provide clearance for the installation of spikes.

3. A guide rail support assembly according to claim 1, wherein the brace has no apertures, and the plurality of hooks extend completely around the brace without penetrating any portion of the brace; and further comprising:

a vertical stop on the brace for limiting upward vertical travel of the hook device relative to the brace.

4. A guide rail support assembly according to claim 1, wherein the brace has a rear flange extending in a direction perpendicular to the longitudinal direction opposite the guide rail, the rear flange being located on a lower end thereof for increasing a cross-sectional area of the brace for contacting a tie plate.

5. A guide rail support assembly according to claim 1, wherein a vertically uppermost area of contact with the spacer block is located laterally rearward of the area of contact with the hook device, and the area of contact with the hook device is located vertically between the two areas of contact with the spacer block.

6. A guide rail support assembly according to claim 1, further comprising a plate to which the brace is mounted, the plate having a pair of holes on opposite longitudinal sides of the brace for receiving spikes extending through the holes for securing the plate to an underlying tie.

7. A railroad section, comprising:

a plurality of plates;

a pair of rails mounted to the plates;

a guide rail support assembly mounted to the plates adjacent at least one of the rails; the guide rail support assembly comprising:

a plurality of braces, each of which is mounted to one of the plates and each having a horizontal front ledge and a vertical rear wall opposite the front ledge;

a guide rail positioned on the front ledges of the braces, the guide rail having a longitudinal length that defines a longitudinal direction;

a plurality of hook devices, each having a base and a pair of hooks extending from the base completely around sides of the brace without penetrating the brace and securing the guide rail to the braces;

a plurality of spacer blocks, each positioned between a respective one of the bases and the braces;

adjustment shims positioned between respective ones of the spacer blocks and the rear walls of the braces; and a plurality of spring clips, each mounted in one area of contact to a respective one of the bases and engaging a respective one of the spacer blocks in two areas of contact for securing the hook devices to the braces.

8. A railroad section according to claim 7, wherein one hook is located on each lateral side of a respective one of the braces relative to the longitudinal direction, each hook having a concave recess formed in an outer surface thereof adapted to provide clearance for the installation of spikes.

9. A railroad section according to claim 8, wherein each plate has at least one hole on each lateral side of a respective one of the braces adjacent the concave recesses of respective ones of the hooks, each of said at least one hole receiving a spike extending therethrough for rigidly securing the plates to underlying ties.

10. A railroad section according to claim 7, wherein the braces have no apertures, and the hooks extend completely around respective ones of the braces without penetrating any portion of the braces; and further comprising:

vertical stops on the braces for limiting upward vertical travel of the hook devices relative to the braces.

11. A railroad section according to claim 7, wherein the braces have rear flanges extending in a direction perpendicular to the longitudinal direction opposite the guide rail, the rear flanges being located on lower ends of the braces for increasing a cross-sectional area of the braces for contacting the plates.

12. A railroad section according to claim 7, wherein a vertically uppermost area of contact with each of the spacer blocks is located laterally rearward of a respective area of contact with the hook device, and the respective area of contact with the hook device is located vertically between the two areas of contact with a respective one of the spacer blocks.

* * * * *